US006463698B1

(12) United States Patent
Hofmann

(10) Patent No.: US 6,463,698 B1
(45) Date of Patent: Oct. 15, 2002

(54) JAM PROTECTION FOR A POWER-OPERATED CLOSING DEVICE

(75) Inventor: Knut Hofmann, Wangen (DE)

(73) Assignee: Metzeler Automotive Profiles GmbH, Lindau (DE)

( * ) Notice: Subject to any disclaimer, the term of this patent is extended or adjusted under 35 U.S.C. 154(b) by 0 days.

(21) Appl. No.: 09/701,155

(22) PCT Filed: Mar. 21, 2000

(86) PCT No.: PCT/EP00/02500

§ 371 (c)(1),
(2), (4) Date: Jan. 17, 2001

(87) PCT Pub. No.: WO00/57012

PCT Pub. Date: Sep. 28, 2000

(30) Foreign Application Priority Data

Mar. 23, 1999 (DE) ..... 199 13 106

(51) Int. Cl.[7] ..... E05F 15/02
(52) U.S. Cl. ..... 49/28
(58) Field of Search ..... 49/28, 26, 27; 200/61.43

(56) References Cited

U.S. PATENT DOCUMENTS 3,855,733 A * 12/1974 Miller ..... 49/488
4,273,974 A * 6/1981 Miller ..... 200/61.43
4,972,054 A * 11/1990 Miller et al. ..... 200/61.43
5,148,911 A * 9/1992 Miller et al. ..... 200/61.43
5,384,982 A * 1/1995 Galperin ..... 49/27
5,832,665 A * 11/1998 Miller et al. ..... 49/27
5,998,951 A * 12/1999 Dove ..... 318/282

FOREIGN PATENT DOCUMENTS

| | | |
|---|---|---|
| DE | 197 20 713 C1 | 5/1998 |
| DE | 197 01 412 A1 | 7/1998 |
| WO | WO 98/52785 | 3/2000 |

* cited by examiner

*Primary Examiner*—David M. Purol
(74) *Attorney, Agent, or Firm*—Stephen B. Salia, Esq.; Brian B. Shaw, Esq.; Harter, Secrest & Emery LLP

(57) ABSTRACT

A trapping protector (1) for disposition about an opening in a vehicle body such as a sun roof includes a hollow profile (12) for a power-operated closing device (14) for closing the opening. Terminals (16) are provided at one end of the hollow profile (12) and a function-checking arrangement (28) is provided at the other end of the hollow profile (12). The two ends (23, 24) are brought close together and are axially aligned along a longitudinal centerline and the function-checking arrangement (28) as well as the terminals (16) are arranged laterally offset from the longitudinal centerline (13) of the hollow profile (12) to thus achieve a trapping protector function along substantially the entire periphery of the opening.

11 Claims, 2 Drawing Sheets

JAM PROTECTION FOR A POWER-OPERATED CLOSING DEVICE

Figure 1:
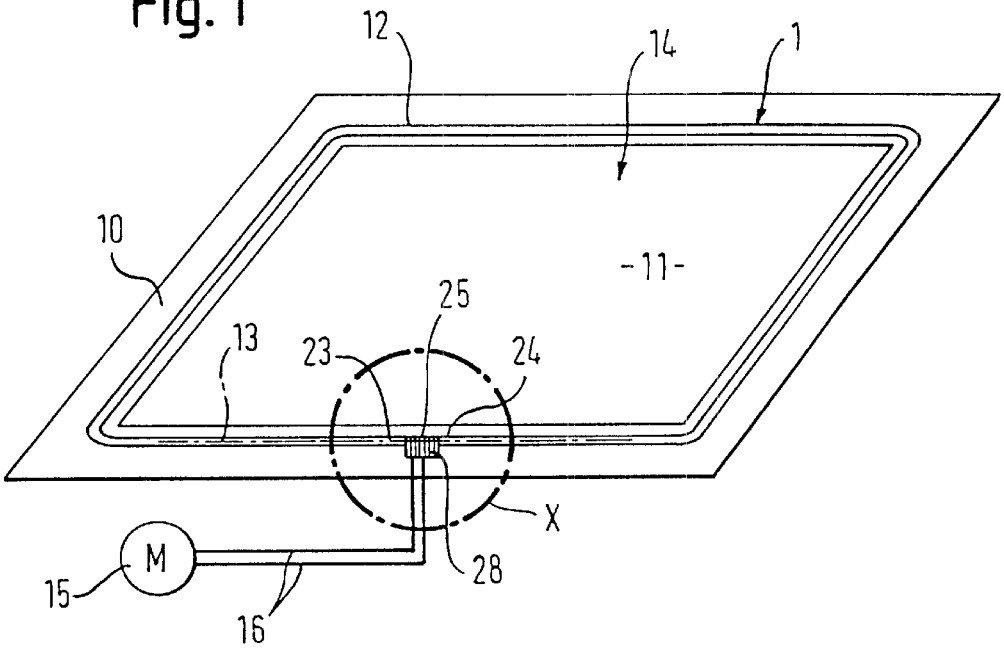

The invention relates to a trapping protector for a power-operated closing device, more particularly for a motor vehicle sunroof, including an elastomer hollow profile comprising electrical conductive portions spaced away from each other whose contact triggers a switching action of a drive assembly of the closing device, terminals for the electrical conductive portions being provided at one end of the hollow profile and a function-checking means being provided at the other end of the hollow profile.

One such trapping protector is known from DE 197 20 713 C1 assigned to the same applicant. Provided at one end of the hollow profile is a means for checking proper functioning of the trapping protector, this function-checking means often being configured as a resistor. Provided at the other end of the hollow profile are terminals for connecting to a host controller of the drive assembly for the closing device. This portion may be several centimeters long. With the known trapping protector achieving a trapping protector function along the whole length is not possible.

The invention is thus based on the objective of providing a trapping protector achieving a trapping protector function along the whole length.

This objective is achieved in a trapping protector of the aforementioned kind in that the two ends are brought close together and the function-checking means as well as the terminals are arranged laterally offset from the longitudinal centerline of the hollow profile.

Laterally offsetting the function-checking means and the terminals results in these components being located alongside or below the trapping protector so that the electrical conductive portions can be brought closer together, thus substantially reducing the size of the portion in which no trapping protector function is provided. In actual practice the width of this portion can be reduced to a few millimeters so that the portion as a rule is smaller than the objects trapped. Accordingly, in a trapping action precisely in the portion between the two ends either one of the two ends or both ends is/are deformed in common to thus activate the trapping protector. This thus reliably provides the desired trapping protector function on all sides.

Advantageous aspects of the invention read from the dependent claims.

Advantageously, the terminals are arranged on the same side of the hollow profile as the function-checking means to thus achieve a compact design of the trapping protector in accordance with the invention whilst simultaneously simplifying assembly.

In one advantageous aspect the two ends of the hollow profile are mechanically connected to each other and insulated from each other electrically. The mechanical connection of the two ends provides for added strength and stability whilst the function of the hollow profile is not detrimented by the electrical insulation of the two ends from each other.

In accordance with one advantageous further embodiment a spacer is inserted between the two ends of the hollow profile, this spacer facilitating connecting the two ends of the hollow profile mechanically.

Advantageously, the spacer comprises a hollow. This hollow facilitates deformation of the spacer so that the hollow profile in accordance with the invention is already activated by light forces in the portion of the ends connected to each other.

In another advantageous further embodiment the two ends and bonded to each other or to the spacer by means of an electrically insulating adhesive, more particularly a PE adhesive. This electrically insulating adhesive permits a speedy and simple connection whilst providing the necessary electrical insulation between the two ends.

In a further advantageous aspect the two ends to be connected to each other are potted in plastics, this potting reliably sealing the two ends from the environment and preventing the ingress of moisture.

In yet another advantageous aspect the function-checking means and the terminals are surrounded by the potting of the ends. The two ends and the function-checking means as well as the terminals may be potted all at the same time to thus simplify production, the function-checking means and the terminals thereby being reliably protected from ingress of moisture.

Figure 2:
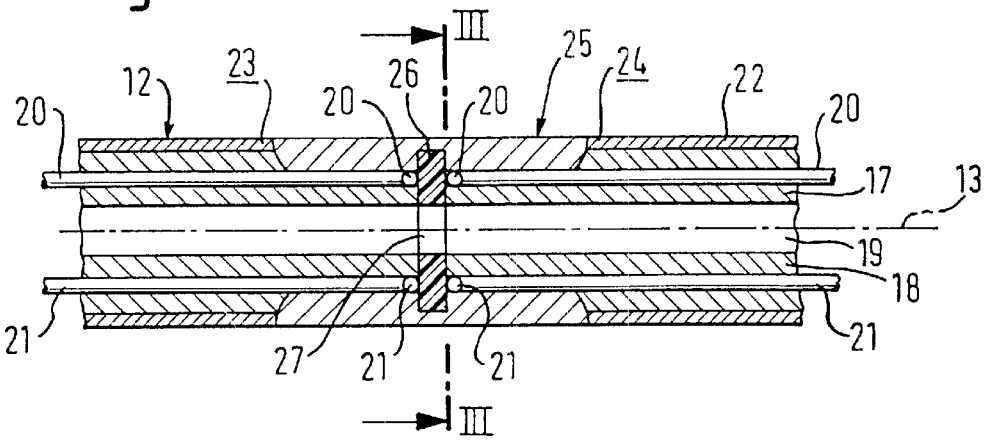
Figure 3:
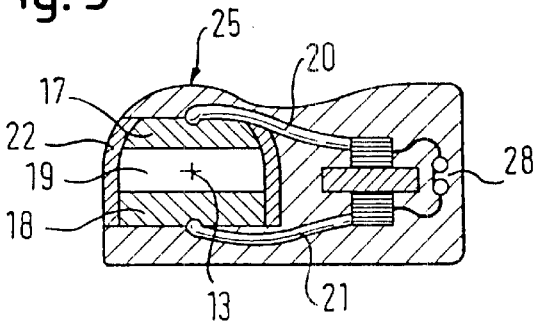
Figure 4:
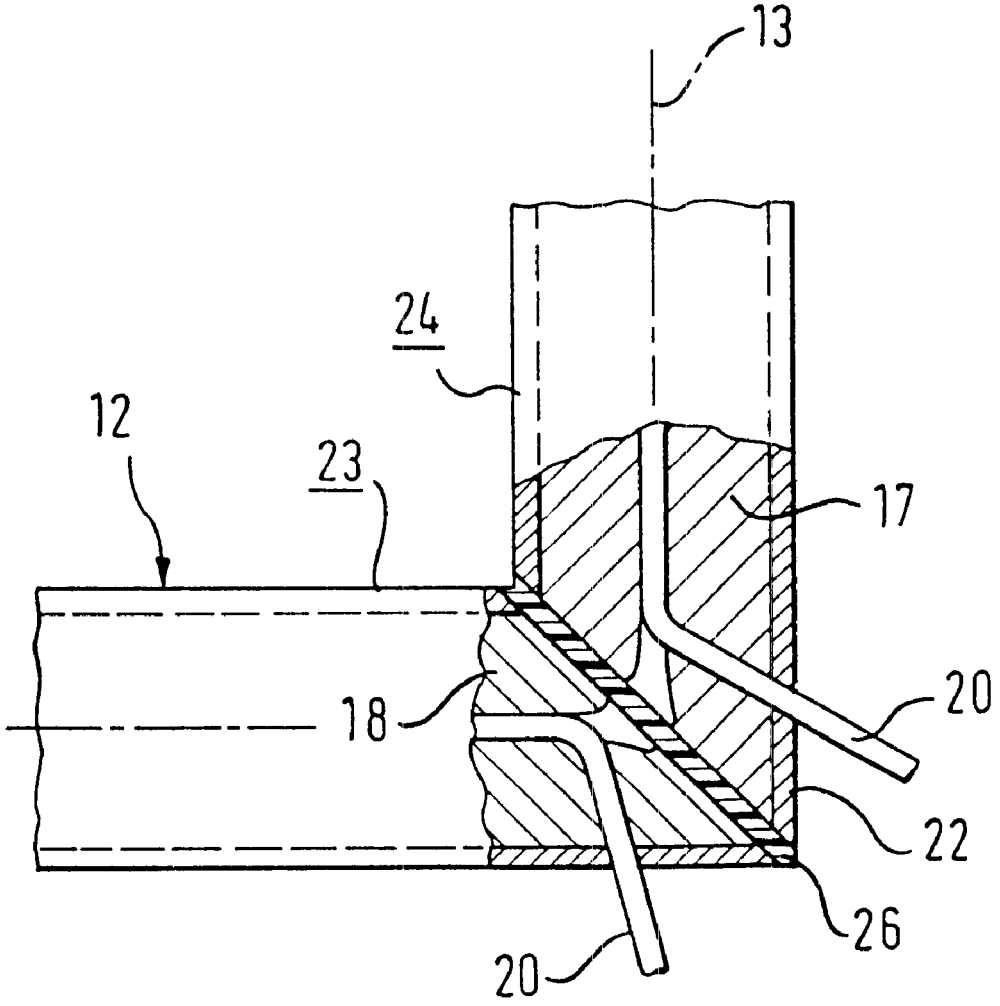

The invention will now be detailed by way of example embodiments with reference to the drawing in which:

| | |
|---|---|
| FIG. 1 | is a schematic view in perspective of a trapping protector incorporated in accordance with the invention; |
| FIG. 2 | is a section view of the magnified detail X taken from FIG. 1; |
| FIG. 3 | is a section view take along the line 111-111 in FIG. 2, and |
| FIG. 4 | is a horizontal section view through a corner joint between the two ends of the trapping protector portion in accordance with the invention. |

Referring now to FIG. 1 there is illustrated schematically a roof aperture 10 including a roof opening 11. The roof opening 11 is surrounded by a trapping protector 1 on all sides comprising a hollow profile 12. To close off the roof opening 11 a sunroof 14 is employed. The ends 23, 24 of the hollow profile 12 are connected to each other potted together by potting 25.

The end 23 is provided with terminals 16 connecting a drive assembly 15 for powering the sunroof 14. The other end 24 is provided with a means 28 for function-checking the trapping protector 1. The function-checking means 28 is arranged laterally offset from the longitudinal centerline 13 of the hollow profile 12. The terminals 16 are arranged on the same side as the function-checking means 28. The two ends 23, 24 are brought close together so that a trapping protector function is achieved on all sides of the roof aperture 10 along the whole length of the trapping protector 1.

Referring now to FIGS. 2 and 3 there is illustrated more in detail the connection between the ends 23, 24. The hollow profile 12 comprises two electrically conducting portions 17, 18 spaced away from each other by a gap 19. Embedded in each portion 17, 18 is a metallic conductor 20, 21 to reduce the contact resistance. The function-checking means 28 and the terminals 16 are joined to these conductors 20, 21. The hollow profile 12 comprises furthermore a sheath 22 surrounding the electrically conducting portions 17, 18. The sheath 22 is made of an electrically nonconductive material to thus insulate the two portions 17, 18 from each other and from the surroundings.

Inserted between the two ends 23, 24 is a spacer 26 incorporating a hollow 27. The dimensions of the hollow 27 correspond to those of the gap 19. The spacer 26 is made of an electrically insulating material. The ends 23, 24 are bonded to the spacer 26 and thus mechanically connected to each other. Use is made of an electrically insulating adhesive to ensure the necessary electrical insulation of the two ends 23, 24 from each other.

Referring now to FIG. 3 there is illustrated schematically how the end 24 of the hollow profile 12 is provided with a function-checking means 28. The conductors 20, 21 are brought out laterally from the hollow profile 12, the function-checking means 28 thus being laterally offset from the longitudinal centerline 13 of the hollow profile 12. At the other end 23 too the conductors 20, 21 are brought out laterally from the hollow profile 12 and connected to the terminals 16. The terminals 16 are arranged laterally offset from the longitudinal centerline 13.

To seal the connecting portion between the ends 23, 24 a potting 25 is provided. The ends 23, 24 are trimmed in the connecting portion and then bonded to the spacer 26. After connection of the function-checking means 28 and terminals 16 to the conductors 20, 21, the potting 25 is injection molded. The potting 25 surrounds the ends 23, 24, the terminals 16 and the function-checking means 28 to thus achieve good insulation against ingress of moisture.

The connecting portion between the ends 23, 24 is only a few millimeters wide, this width being substantially dictated by the thickness of the spacer 26. The width of any object trapped is, as a rule, more than the thickness of the spacer 26. Should an object become trapped one of the two or both ends 23, 24 is/are deformed in common to thus result in the electrically conducting portions 17, 18 coming into contact with each other and triggering a switching action which signals the drive assembly 15 for powering the sunroof 14. In this arrangement the movement of the sunroof 14 is halted or reversed. Due to the hollow 27 in the spacer 26 the hollow profile 12 is activated even by slight forces.

The potting 25 is configured flush with the sheath 22 of the hollow profile 12 to thus achieve a uniform smooth surface throughout, pleasing in appearance.

Referring now to FIG. 4 there is illustrated a horizontal section through a corner joint of the ends 23, 24. For a better overview the terminals 16 as well as the function-checking means 28 have been left out of the illustration. It is to be noted also that like parts or like in function with those as shown in FIGS. 1 to 3 are identified by the same reference numerals, reference being made to the discussion above for furthermore explanations and to prevent tedious repetition.

The connecting portion between the two ends 23, 24 may also be located in a comer as shown in FIG. 4, a joint being provided between the ends 23, 24 in any case with a hollow profile 12 provided on all sides. Locating said joint in a comer streamlines the hollow profile 12 in the portions configured straight whilst simultaneously providing the desired trapping protector function in the connecting portion, too.

The trapping protector 1 in accordance with the invention achieves a trapping protector function on all sides at low production and assembly expense.

What is claimed is:

1. A trapping protector for a power-operated closing device, including an elastomer hollow profile comprising electrically conductive portions spaced away from each other whose contact triggers a switching action of a drive assembly of said device, terminals for said electrical conductive portions being provided at one end of said hollow profile and a function-checking means being provided at an opposite end of said hollow profile, in which said two ends are brought close together so as to lie one adjacent the other along a longitudinal centerline of said hollow profile and said function-checking means as well as said terminals are arranged laterally offset from said longitudinal centerline of said hollow profile.

2. The trapping protector as set forth in claim 1, characterized in that said terminals (16) are arranged on the same side of said hollow profile (12) as said function-checking means (28).

3. The trapping protector as set forth in claim 1 or 2, characterized in that said two ends (23, 24) of said hollow profile (12) are mechanically connected to each other and insulated from each other electrically.

4. The trapping protector as set forth in claim 3, characterized in that a spacer (26) is inserted between said two ends (23, 24) of said hollow profile (12).

5. The trapping protector as set forth in claim 4, characterized in that said spacer (26) is made of an electrical insulation material.

6. The trapping protector as set forth in claim 4 or 5, characterized in that said spacer (26) comprises a hollow (27).

7. The trapping protector as set forth in any of the claims 3 to 6, characterized in that said two ends (23, 24) are bonded to each other or to said spacer (26) by means of an electrically insulating adhesive, more particularly a PE adhesive.

8. The trapping protector as set forth in any of the claims 3 to 7, characterized in that said two ends (23, 24) to be connected to each other are potted (25) in plastics.

9. The trapping protector as set forth in claim 8, characterized in that said function-checking means (28) and said terminals (16) are surrounded by said potting (25) of said ends (23, 24).

10. The trapping protector as set forth in claim 1 in which said function-checking means is a resistor.

11. A trapping protector for a power-operated closing device comprising:

a) an elongated elastomer hollow profile having opposite ends, the hollow profile extending around the periphery of an opening to be closed by the power-operated device such that the opposite ends of the hollow profile are disposed one adjacent the other and are axially aligned along a longitudinal centerline of said hollow profile;

b) electrically conductive portions on said hollow profile spaced away from each other whose contact along the length of the profile triggers a switching action of a drive assembly of said power-operated closing device;

c) terminals for said electrical conductive portions provided at one of said opposite ends of said hollow profile;

d) a function-checking means provided at the other of said opposite ends of said hollow profile such that said terminals and function-checking means are brought close together; and e) said function-checking means as well as said terminals are arranged laterally offset from said longitudinal centerline of said hollow profile.

* * * * *

UNITED STATES PATENT AND TRADEMARK OFFICE

CERTIFICATE OF CORRECTION

PATENT NO. : 6,463,698 B1
DATED : October 15, 2002
INVENTOR(S) : Knut Hofmann

It is certified that error appears in the above-identified patent and that said Letters Patent is hereby corrected as shown below:

Title page, Item [54] and Column 1, lines 1 and 2,
Title reading "JAM PROTECTION FOR A POWER-OPERATED CLOSING DEVICE", should read as -- TRAPPING PROTECTOR FOR A POWER OPERATED CLOSING DEVICE --.

Item [74], *Attorney, Agent, or Firm* information reading "Salia", should read as -- Salai --.

Signed and Sealed this

Fifteenth Day of April, 2003

JAMES E. ROGAN
*Director of the United States Patent and Trademark Office*